US011701701B2

(12) United States Patent
Maeda et al.

(10) Patent No.: US 11,701,701 B2
(45) Date of Patent: Jul. 18, 2023

(54) METHOD FOR JOINING MEMBERS

(71) Applicant: Kobe Steel, Ltd., Kobe (JP)

(72) Inventors: Yasuhiro Maeda, Kobe (JP); Toru Hashimura, Kobe (JP); Taiki Yamakawa, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 17/762,243

(22) PCT Filed: Sep. 14, 2020

(86) PCT No.: PCT/JP2020/034747
§ 371 (c)(1),
(2) Date: Mar. 21, 2022

(87) PCT Pub. No.: WO2021/070571
PCT Pub. Date: Apr. 15, 2021

(65) Prior Publication Data

US 2022/0339689 A1 Oct. 27, 2022

(30) Foreign Application Priority Data

Oct. 9, 2019 (JP) ..... 2019-186176

(51) Int. Cl.
*B21D 39/20* (2006.01)

(52) U.S. Cl.
CPC ..... *B21D 39/206* (2013.01)

(58) Field of Classification Search
CPC ..... B21D 39/206; B21D 39/06
See application file for complete search history.

(56) References Cited

U.S. PATENT DOCUMENTS 2,405,399 A * 8/1946 Bugg ..... B21D 39/06 29/523
3,555,866 A * 1/1971 Roth ..... B26F 3/04 413/1
3,675,949 A * 7/1972 Dawson ..... F16L 19/0218 285/354

(Continued)

FOREIGN PATENT DOCUMENTS

DE 36 04 994 A1 8/1987
EP 0 296 269 B1 12/1988

(Continued)

OTHER PUBLICATIONS

Extended European Search Report dated Sep. 2, 2022 in European Patent Application No. 20875260.0, 8 pages.

(Continued)

*Primary Examiner* — Lawrence Averick
(74) *Attorney, Agent, or Firm* — Oblon, McClelland, Maier & Neustadt, L.L.P.

(57) ABSTRACT

A method joins members for joining a first member being cylindrical and a second member being plate-shaped and having an opening. This method includes: inserting a first member into an opening of the second member; inserting an elastic body into the first member; guiding an outer diameter side of the first member with a pair of outer dies on both sides of the second member; and compressing an elastic body in the first member with a pair of inner dies. The inner dies compress the elastic body within a range in which the outer dies are positioned.

7 Claims, 3 Drawing Sheets

(56) References Cited

U.S. PATENT DOCUMENTS

| | | | | |
|---|---|---|---|---|
| 3,786,622 | A * | 1/1974 | Negishi | D01H 4/08 57/415 |
| 6,874,384 | B1 * | 4/2005 | Freiwald | F16B 9/052 403/279 |
| 8,544,305 | B2 * | 10/2013 | Watabe | F27D 5/0006 72/58 |

FOREIGN PATENT DOCUMENTS

| | | | |
|---|---|---|---|
| JP | 51-133170 | A | 11/1976 |
| JP | 9-192760 | A | 7/1997 |
| JP | 4664103 | B2 | 4/2011 |
| JP | 2019-151170 | A | 9/2019 |
| WO | WO 2018/025667 | A1 | 2/2018 |
| WO | WO-2018025667 | A1 * | 2/2018 |

OTHER PUBLICATIONS

International Search Report dated Oct. 27, 2020 in PCT/JP2020/034747 filed Sep. 14, 2020, 2 pages.

* cited by examiner

METHOD FOR JOINING MEMBERS

CROSS-REFERENCE TO RELATED APPLICATIONS

This is a national phase application in the United States of International Patent Application No. PCT/JP2020/034747 with an international filing date of Sep. 14, 2020, which claims priority of Japanese Patent Application No. 2019-186176 filed on Oct. 9, 2019, the contents of which are incorporated herein by reference.

TECHNICAL FIELD

The present invention relates to a method for joining members.

BACKGROUND ART

High-strength steel sheets referred to as high-tension steel are used to reduce the weight and improve safety of vehicles. Although the high tension steel is effective in reducing weight and improving safety, the high tension steel is heavier than low specific gravity material such as aluminum. In addition, when high tension steel is used, it causes problems such as a decrease in formability, an increase in a forming load, and a decrease in dimensional accuracy, due to high strength of the steel. In order to solve these problems, in recent years, multi-materialization of using, in combination with steel parts, extrusion-molded products, cast products, or press-molded products that use aluminum having a lower specific gravity than steel has been performed.

The problem with multi-materialization is the joining of dissimilar metals such as steel parts and aluminum parts. Generally, it is difficult to join dissimilar metals having different properties as described above, but, for example, JP S51-133170 A and JP H9-192760 A disclose methods for joining members of enabling dissimilar metals to be joined in multi-materialization with utilizing an elastic body. Specifically, in methods for joining members of JP S51-133170 A and JP H9-192760 A, a pipe body is inserted into a hole portion of a wall surface body (plate member), an elastic body (urethane elastic body) is inserted inside the pipe body (pipe member), and the elastic body is pressed to be deformed, whereby the pipe body is expanded, and the wall surface body and the pipe body are caulked and joined.

Patent Document 1: JP S51-133170 A

Patent Document 2: JP H9-192760 A

SUMMARY OT THE INVENTION

Problems to be Solved by the Invention

In the joining method disclosed in JP S51-133170 A, a punch and a die press an elastic body to expand the pipe body to caulk and join the wall surface body and the pipe body. Therefore, when the pipe body is expanded with the elastic body, the punch and the die may bite into the elastic body, and the elastic body may be locally distorted or cracked in some cases.

In the joining method disclosed in JP H9-192760 A, an elastic body is sandwiched between a perforated disk and a disk with a mandrel having a mandrel inserted into the hole, and the mandrel is pulled to bring the disks closer to each other, whereby the elastic body is compressed. Therefore, the disk may bite into the elastic body, and the elastic body may be locally distorted or cracked as described above.

An object of the present invention is to provide a method for joining members that can prevent local distortions and cracks occurring in the elastic bodies when the members are joined to each other with an elastic body.

Means for Solving the Problems

As a means for solving the above problems, the present invention provides a method for joining members for joining a first member being cylindrical and a second member being plate-shaped and having an opening, the method including: inserting a first member into an opening of the second member; inserting an elastic body into the first member; guiding an outer diameter side of the first member with a pair of outer dies on both sides of the second member; and compressing an elastic body in the first member with a pair of inner dies. The inner dies compress the elastic body within a range in which the outer dies are positioned.

According to this, since it is within the range where the outer die is positioned that the outer die guides the outer diameter side of the first member and the inner die compresses the elastic body, the inner die does not bite into the elastic body. Therefore, local distortions and cracks do not occur in the elastic body.

The inner dies are arranged one above the other and the elastic body has only to be compressed by at least any one of the inner dies.

The outer die preferably includes a plurality of split dies.

According to this, even when the first member has a long structure, as long as the outer die is a split die, the outer die can be easily arranged around the first member.

It is preferable that the outer die is formed with a recessed portion in which an opening area gradually increases toward an end surface, and the inner die does not protrude into the recessed portion.

According to this, when the elastic body is compressed by the inner die, the elastic body can be smoothly and elastically deformed in the direction orthogonal to the compression direction due to the presence of the recessed portion.

Effect of the Invention

According to the present invention, when the members are joined to each other with an elastic body, local distortions and cracks occurring in the elastic bodies can be prevented.

DESCRIPTION OF EMBODIMENTS

Figure 1:
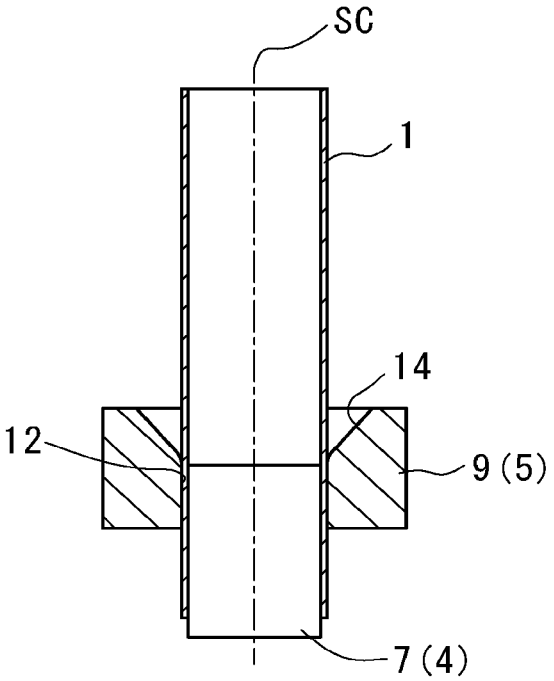
FIG. 1 is a schematic cross-sectional view showing a first step in a method for joining members according to the present embodiment.

Hereinafter, an embodiment according to the present invention will be described with reference to the accompanying drawings. It should be noted that the following description is, fundamentally, merely exemplary and is not intended to limit the present invention, applicable objects thereof, or use thereof. In addition, the drawings are schematic, and the ratio and the like of each dimension are different from actual ones.

FIGS. 1 to 4 are schematic cross-sectional views for illustrating a method for joining members according to the present embodiment. The member to be joined includes a first member 1 and a second member 2.

The first member 1 has a hollow cylindrical shape. The second member 2 is plate-shaped and has a circular opening 3 into which the first member 1 can be inserted. A material having a higher strength than that of the first member 1 is used for the second member 2. The strength means mechanical strength, and corresponds to, for example, tensile strength, yield stress, and the like. An aluminum alloy is used for the first member 1, for example. The tensile strength of the aluminum alloy is 400 MPa or less. A high tension steel is used for the second member 2, for example. The tensile strength of the high tension steel is 400 to 1000 MPa.

The joining device used for joining the first member 1 and the second member 2 includes a die including a pair of upper and lower inner dies 4 and outer dies 5, and an elastic body 6 inserted into the first member 1.

The inner die 4 is made of a material generally used as a die, such as carbon steel. The inner die 4 includes a first inner die 7 arranged on the lower side and functioning as a die, and a second inner die 8 arranged on the upper side and functioning as a punch. The upper end surface of the first inner die 7 is the first abutting surface 7*a* that abuts on the lower end surface of the elastic body 6 described below. The lower end surface of the second inner die 8 is the second abutting surface 8*a* that abuts on the upper end surface of the elastic body 6. The first inner die 7 and the second inner die 8 are arranged on the same axis SC extending in the vertical direction.

The first inner die 7 and the second inner die 8 are cylindrical, and the first inner die 7 is configured to move up and down with respect to the second inner die 8. The first inner die 7 is attached to the main body of the joining device (not shown). A press machine (not shown) is used to raise and lower the second inner die 8. The outer diameter dimension of the first inner die 7 and the second inner die 8 is slightly smaller than the inner diameter dimension of the first member 1. The first inner die 7 and the second inner die 8 can be inserted into the internal space from the upper and lower opening ends of the first member 1, respectively.

The outer die 5 is also made of a material generally used as a die, such as carbon steel. The outer die 5 includes a first outer die 9 and a second outer die 10. The first outer die 9 is arranged on the lower side, and guides the outer diameter side of the first member 1 with the first inner die 7. The second outer die 10 is arranged on the upper side, and guides the outer diameter side of the first member 1 with the second inner die 8. The first outer die 9 and the second outer die 10 are arranged on the same axis SC extending in the vertical direction, which is the same as the inner die 4. The second outer die 10 is attached to an elevating table (not shown) and is raised and lowered by an elevating mechanism (not shown). The elevating operation of the second outer die 10 is independent of the second inner die 8. After the second outer die 10 descends to the first set position (see FIG. 3), the second inner die 8 further descends to the second set position (see FIG. 4).

Figure 4:
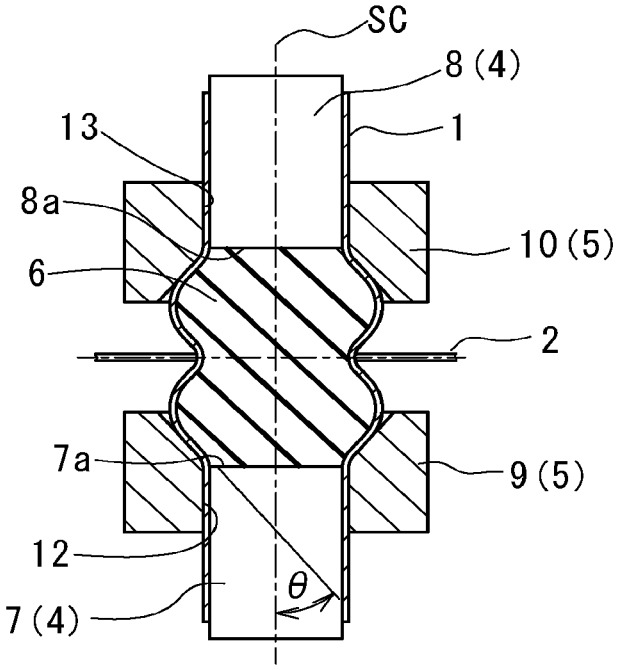
FIG. 4 is a schematic cross-sectional view showing a fourth step in the method for joining members according to the present embodiment.

The first outer die 9 and the second outer die 10 are cylindrical, and the inner diameter dimension of the center hole 11 is slightly larger than the outer diameter dimension of the first member 1. An annular gap (first annular space 12) is formed between the inner circumferential surface of the first outer die 9 and the outer circumferential surface of the first inner die 7, and the lower portion of the first member 1 can be inserted into the gap. An annular gap (second annular space 13) is formed also between the inner circumferential surface of the second outer die 10 and the outer circumferential surface of the second inner die 8, and the upper portion of the first member 1 can be inserted into the gap. In addition, a first recessed portion 14 and a second recessed portion 15 respectively are formed on the end faces, that is, facing surfaces of the first outer die 9 and the second outer die 10. The first recessed portion 14 and the second recessed portion 15 are formed in a conical surface shape in which the opening area gradually decreases in the depth direction. Here, as shown in FIG. 4, the angle θ formed by the conical surface, which is constituting the first recessed portion 14 and the second recessed portion 15, and the axial direction is designed to be about 45°. However, this angle θ has only to be determined based on the amount of elastic deformation outward in the radial direction with respect to the amount of compression, which changes according to the material and size of the elastic body 6. That is, the angle θ has only to be set so that the first member 1 whose shape is changed by the elastic deformation of the elastic body 6 does not come into pressure contact with the first recessed portion 14 or the second recessed portion 15.

The elastic body 6 is cylindrical and is made of an elastic material. The elastic materials that can be used include, for example, urethane rubber, chloroprene rubber, CNR rubber (chloroprene rubber+nitrile rubber), silicon rubber, and the like. The hardness of the elastic material used is preferably 30 or more on Shore A. The elastic body 6 has an outer diameter dimension before elastic deformation slightly smaller than the inner diameter dimension of the first member 1, and can be inserted into the first member 1. The elastic body 6 is elastically deformed radially outward by being compressed in the axial direction SC by the inner die 4.

Next, a method for joining the first member 1 and the second member 2 will be described.

As shown in FIG. 1, the first member 1 is inserted into the first annular space 12 to be formed between the first inner die 7 and the first outer die 9 with the second inner die 8 and the second outer die 10 raised (first step). The first outer die 9 is formed with a first recessed portion 14. Therefore, the inserted first member 1 can be smoothly guided from the first recessed portion 14 to the first annular space 12. The inserted first member 1 has its lower end opening supported by a part of the main body of the joining device and is positioned in the vertical direction.

Figure 2:
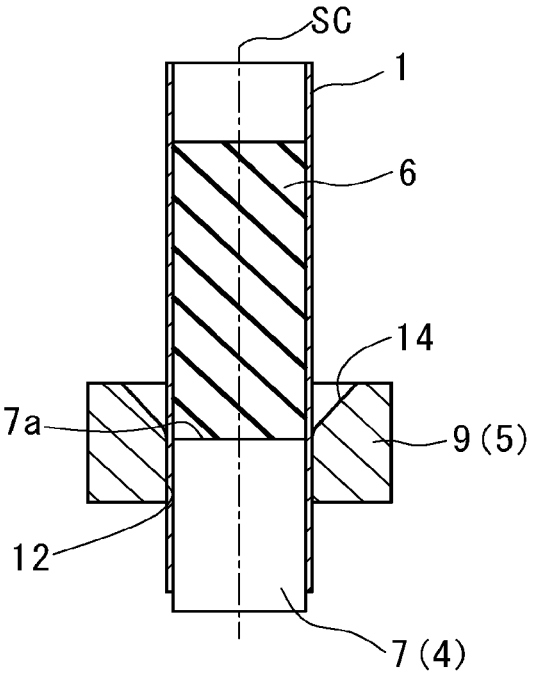
FIG. 2 is a schematic cross-sectional view showing a second step in the method for joining members according to the present embodiment.

As shown in FIG. 2, the elastic body 6 is inserted into the first member 1 (second step). The elastic body 6 has its lower end surface abutting on the first abutting surface of the first inner die 7, thereby being positioned in the vertical direction.

Figure 3:
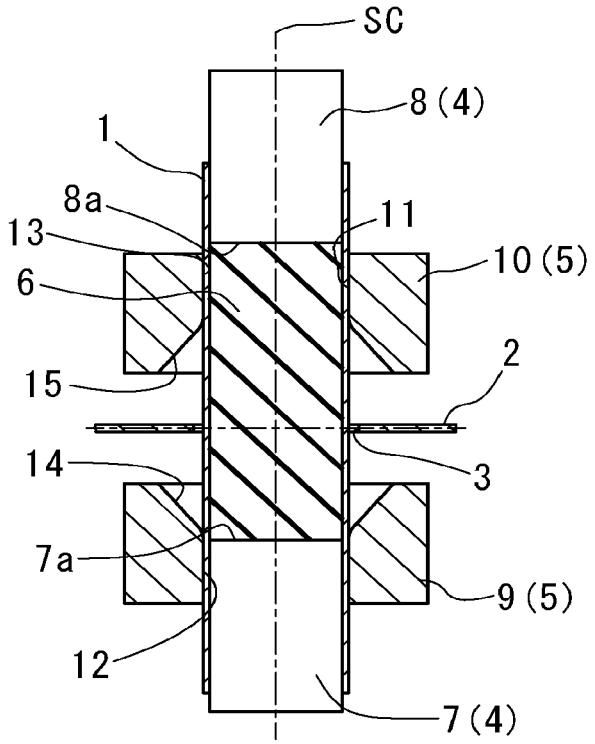
FIG. 3 is a schematic cross-sectional view showing a third step in the method for joining members according to the present embodiment.

As shown in FIG. 3, the second member 2 is arranged on the outer diameter side of the first member 1 (third step). That is, the second member 2 is attached to the elevating table, and lowered together with the second outer die 10. Thus, the first member 1 is inserted into the opening 3 of the second member 2, and the second member 2 moves to the joining position CP. In the state where the second member 2 is moved to the joining position CP, the second outer die 10 is positioned at a position plane-symmetrical with the first outer die 9 about the joining position CP. At this time, the second abutting surface 8*a* of the second inner die 8 abuts on the upper end surface of the elastic body 6.

As shown in FIG. 4, the second inner die 8 is lowered (fourth step). As a result of the descent of the second inner die 8, the elastic body 6 positioned between the second inner die 8 and the first inner die 7 is compressed in the axial direction and elastically deformed outward in the radial direction. When the elastic body 6 elastically deforms outward in the radial direction, the first member 1 has the inner circumferential surface pressed and changes its shape outward in the radial direction. At the center position of the first outer die 9 and the second outer die 10, the second member 2 formed of a material having a strength higher than that of the first member 1 is positioned, and deformation outward in the radial direction of the first member 1 is blocked. Therefore, the elastic body 6 is suppressed in deformation at the portion where the second member 2 is positioned, and is elastically deformed radially outward on both sides thereof. The elastic body 6 elastically deforms radially outward at both side portions of the second member 2, whereby the first member 1 brings a part of the outer circumferential surface into pressure contact with the inner surface of the opening 3 of the second member 2 and sandwiches the second member 2 to change the shape to a cross-sectional waveform. Thus, the first member 1 and the second member 2 are joined.

The lowered position of the second inner die 8 is a position at which its lower end portion is within the second outer die 10 and does not protrude into the second recessed portion 15. That is, it is inside the center hole 11 of the second outer die 10 that the elastic body 6 is pressed by the second abutting surface 8*a* of the second inner die 8. Therefore, even when the elastic body 6 is pressed by the second inner die 8, the elastic body 6 has the outer circumferential surface guided by the inner circumferential surface constituting the center hole 11, and is not elastically deformed outward in the radial direction. Therefore, the elastic body 6 does not spread beyond the range of the second abutting surface 8*a* of the second inner die 8. That is, the lower end portion of the second inner die 8 does not bite into the elastic body 6. As a result, it is possible to prevent the elastic body 6 from being locally damaged or cracked by the second inner die 8. On the other hand, the first abutting surface 7*a* of the first inner die 7 is flush with the bottom surface of the first recessed portion 14 formed in the first outer die 9. Therefore, the upper end portion of the first inner die 7 does not bite into the elastic body 6 either. In addition, the elastic body 6 elastically deforms outward in the radial direction, and the amount of deformation is gradually increase by the first recessed portion 14 and the second recessed portion 15. Therefore, it is possible to prevent the amount of deformation of the elastic body 6 from locally and rapidly increasing and causing cracks or the like. Here, the compressibility ratio of the elastic body 6 is set to 30%. That is, when the volume of the elastic body 6 in an unloaded state of not being pressed by the inner die 4 is assumed to be 100%, the volume is compressed up to 70%.

When the first member 1 and the second member 2 are joined, the second inner die 8 and the second outer die 10 are raised and removed from the die. In addition, the elastic body 6 is taken out from the removed first member 1. When the compressed state by the first inner die 7 and the second inner die 8 is released, the elastic body 6 returns to the original cylindrical shape. Therefore, the elastic body 6 can be easily taken out from the first member 1.

According to the method for joining the first member 1 and the second member 2 according to the embodiment, the elastic body 6 is pressed by the second inner die 8 within a range in which the second outer die 10 is positioned, and specifically, in a range being within the center hole 11 and not protruding into the second recessed portion 15. In this range, the second abutting surface of the second inner die 8 and the range where the elastic body 6 is pressed match, and the second abutting surface 8*a* of the second inner die 8 does not bite into the elastic body 6. Therefore, when the elastic body 6 is pressed by the second inner die 8, the elastic body 6 is not locally damaged or cracked. As a result, the elastic body 6 can be used repeatedly for a long period of time, which is economical. In addition, this can be handled by simply adding an outer die 5 to the existing equipment, which is also economical.

It should be noted that in the embodiment, the first member 1 is arranged in the die in the first step, and then the elastic body 6 is inserted into the first member 1 in the second step, but the first step may be performed after the second step is performed. In addition, in the third step, arranging the second member 2 on the outer diameter side of the first member 1 is done after the second step is completed, but may be done before the second step. In addition, in the third step, the second member 2 and the second outer die 10 are positioned at the same time with respect to the first member 1, but the positioning of the second outer die 10 may be performed after the positioning of the second member 2 is completed first.

The present invention is not limited to the configuration described in the above embodiment, and various modifications are possible.

In the above embodiment, the first inner die 7 is moved up and down with respect to the second inner die 8, but the second inner die 8 may be moved up and down with respect to the first inner die 7, or both may be moved up and down. When both are moved up and down, the first outer die 9 and the second outer die 10 respectively have only to be arranged evenly on the upper and lower sides centered on the second member 2, and the first inner die 7 and the second inner die 8 have only to be moved up and down evenly toward the second member 2.

In addition, the axial direction of the dies is not limited to the vertical direction, and may be arranged along other directions such as the horizontal direction. When the dies are arranged along the horizontal direction, it is not necessary to consider the influence of weight as in the case of the vertical direction. Thus, there is an advantage that it is easy to adopt a configuration in which both of the inner dies 4 are evenly moved.

Figure 5:
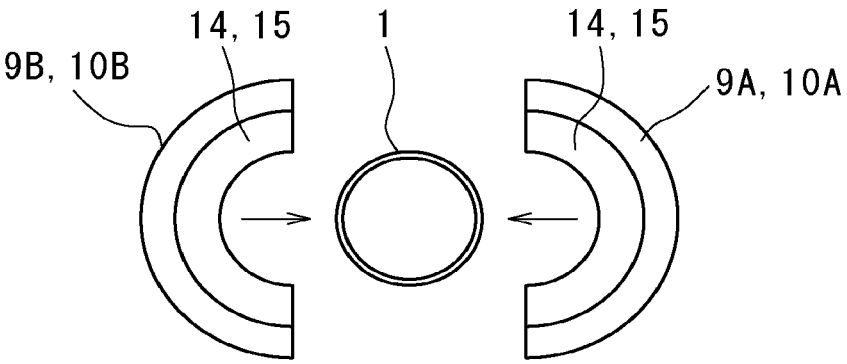
FIG. 5 is a schematic plan view showing an example in which the outer die in FIG. 3 includes two split dies.

In the above embodiment, the outer die 5 is composed of a single member, but the outer die 5 may include a plurality of split dies evenly divided in the circumferential direction. The split dies may include two split dies or three or more split dies. FIG. 5 is a schematic plan view showing an example in which the outer die 5 includes two split dies 9A and 9B (or 10A and 10B). When the first member 1 has a long cylindrical shape and it is difficult or impossible to insert the first member 1 even when the die is opened in the vertical direction, forming the outer die 5 as split dies makes it possible to arrange the outer die 5 around the first member 1.

In the above embodiment, the cross-sectional shape of the first member 1 is circular, but it may be rectangular, or other cross-sectional shape such as triangular or trapezoidal. In this case, it is necessary to fit also the shape of the opening 3 of the second member 2 to the cross-sectional shape of the first member 1. For example, when the first member 1 has a rectangular cross-sectional shape, the opening 3 of the second member 2 has only to have a rectangular shape slightly larger than that of the first member 1. The cross-sectional shape of the inner die 4 also has only to be fitted to the first member 1. The same is true of the shape of the center hole 11 of the outer die 5. However, even if the elastic body 6 has a rectangular cross-sectional shape, the elastic body 6 tends to be elastically deformed to have a circular cross-sectional shape when compressed. Therefore, the outward elastic deformation amount at the central portion of each side is larger than that at both ends. In particular, when the cross section is rectangular, the elastic deformation amount at the central portion of the long side becomes large. Providing the outer die 5 can suppress such deformation.

In the above embodiment, the first recessed portion 14 is formed in the first outer die 9, and the second recessed portion 15 is formed in the second outer die 10, but these are not necessarily required. Any one or both of the recessed portions can be made unnecessary. In addition, the first inner die 7 and the second inner die 8 may be configured to compress the elastic body 6 in the center holes 11 of the first outer die 9 and the second outer die 10. Thus, the first inner die 7 or the second inner die 8 does not bite into the elastic body 6, and the same effect as described above can be obtained.

Figure 6:
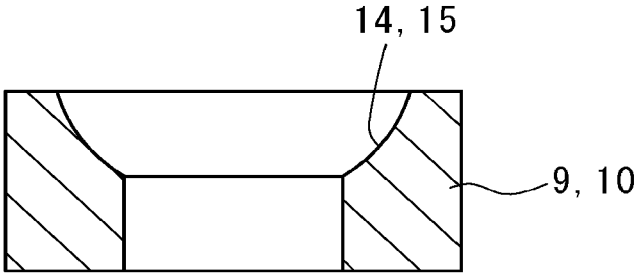
FIG. 6 is a schematic cross-sectional view of an outer die according to another embodiment.
Figure 7:
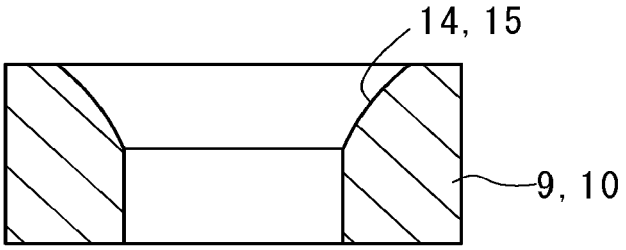
FIG. 7 is a schematic cross-sectional view of an outer die according to still another embodiment.

In addition, the shapes of the first recessed portion 14 and the second recessed portion 15 are not limited to the above-described conical surface, and may be formed by, for example, a recessed curved surface or a protruding curved surface in which the conical surface is curved. FIG. 6 shows an example in which the inner surface constituting the first recessed portion 14 and the second recessed portion 15 is constituted by a recessed curved surface. FIG. 7 shows an example in which the inner surface constituting the first recessed portion 14 and the second recessed portion 15 is constituted by a protruding curved surface.

The invention claimed is:

1. A method for joining members for joining a first member being cylindrical and a second member being plate-shaped and having an opening, the method comprising:

inserting the first member into the opening of the second member;

inserting an elastic body into the first member;

guiding an outer diameter side of the first member with a pair of outer dies on both sides of the second member such that the first member is positioned within an opening of each of the outer dies; and compressing an elastic body in the first member with a pair of inner dies, wherein the inner dies compress the elastic body within a range in which the outer dies are positioned.

2. The method for joining members according to claim 1, wherein the inner dies are arranged one above the other and the elastic body is compressed by at least any one of the inner dies.

3. The method for joining members according to claim 1, wherein the outer die includes a plurality of split dies.

4. The method for joining members according to claim 1, wherein the outer die is formed with a recessed portion in which an opening area gradually increases toward an end surface, and the inner die does not protrude into the recessed portion.

5. The method for joining members according to claim 1, wherein the outer die includes a plurality of split dies, and wherein the outer die is formed with a recessed portion in which an opening area gradually increases toward an end surface, and the inner die does not protrude into the recessed portion.

6. The method for joining members according to claim 2, wherein the outer die is formed with a recessed portion in which an opening area gradually increases toward an end surface, and the inner die does not protrude into the recessed portion.

7. The method for joining members according to claim 2, wherein the outer die includes a plurality of split dies, and wherein the outer die is formed with a recessed portion in which an opening area gradually increases toward an end surface, and the inner die does not protrude into the recessed portion.

* * * * *